United States Patent [19]

Fiedler

[11] 4,248,336

[45] Feb. 3, 1981

[54] PROTECTIVE SHIELD FOR A PARKING METER WINDING RING

[76] Inventor: William Fiedler, 58-29 69th La., Maspeth, N.Y. 11378

[21] Appl. No.: 35,027

[22] Filed: Apr. 30, 1979

[51] Int. Cl.[3] ..... G07F 17/24

[52] U.S. Cl. ..... 194/97 R

[58] Field of Search ..... 58/144; 194/61, DIG. 21, 194/DIG. 22, 97 R

[56] References Cited

U.S. PATENT DOCUMENTS 3,708,049 1/1973 Weber ..... 368/90

3,913,718 10/1975 Zajac ..... 194/DIG. 22

*Primary Examiner*—Stanley H. Tollberg

*Attorney, Agent, or Firm*—Wolder, Gross & Yavner

[57] ABSTRACT

A parking meter mechanism is protected against illegal actuation by a flat annular shield retained in position coaxially with the mechanism winding ring by a leaf spring. The shield surface adjacent the winding ring is coated with a low friction material so that a sharp object inserted through the coin opening of the meter will engage the shield, which then harmlessly slides against the surface of the winding ring.

5 Claims, 6 Drawing Figures

PROTECTIVE SHIELD FOR A PARKING METER WINDING RING

This invention relates primarily to parking meter mechanisms and more particularly to means for such mechanisms to protect against undesired actuation of the winding ring by insertion of a sharp object through the coin opening.

Throughout the United States, it has become necessary to control parking access by means of parking meters. In other words, the function of a parking meter is to insure parking for a designated maximum length of time so that the parking space may be used by others thereafter. This gives the parking public a reasonable length of time to accomplish the purpose of their parking, and yet the access of such parking space the others thereafter. Furthermore, the actuation of a parking meter is primarily accomplished by insertion of one or more coins which provides revenue to the governmental authority for the parking meter and also provides some pressure for the parker to accomplish his business quickly and efficiently in order to save himself money.

Illegal acts performed against the parking mechanisms has now matured into a multi-million dollar business for those committing such acts. For instance, the theft of coins from the coin repository of the parking meter by gaining illegal access thereto is one common form of such illegal activity. Another form, on a much smaller scale, involves obtaining of illegal access to parking time by means of actuating the mechanism with counterfeit coins. In the same manner, the ordinary parker has felt justified in illegally actuating the parking meter mechanism by inserting a sharp object through the coin opening to engage the winding ring of the parking meter. Although the parker rationalizes his actions in that regard by over-taxation or otherwise, it remains a firm fact that his actions are illegal and it is incumbent upon parking meter manufacturers to cope with the problem by preventing such illegal actuation.

Accordingly, a primary object of the present invention is to provide a parking meter mechanism which prevents illegal tampering therewith.

A more specific object of the present invention is to provide a parking meter mechanism which prevents illegal actuation thereof by means of the insertion of a sharp object or the like, through the coin opening to engage and turn the winding ring of the mechanism.

These and other objects of the present invention are provided by a parking meter mechanism which features a flat annular shield placed coaxially with the annular winding ring and retained in position by a leaf spring or other biasing means. Since the winding ring is usually placed with one of its flat surfaces facing the coin opening, insertion of a sharp object through the coin opening for the purpose of engaging the winding ring and turning it to actuate the mechanism will merely engage the shield of the present invention, placed between the winding ring and the coin opening. The shield is provided on its face proximate the winding ring with a non-friction surface, so that engagement of the shield and the consequent turning thereof will merely cause the protective shield to harmlessly slide against the face of the winding ring, without turning the winding ring. Furthermore, the protective shield is provided on its non-friction surface with a plurality of ridges for defining the non-friction contact points and for preventing damage to the winding ring.

Other objects, features and advantages of the present invention will be more fully described in the following detailed description of a preferred, but nonetheless illustrative, embodiment, with reference to the accompanying drawings, wherein.

Figure 1:
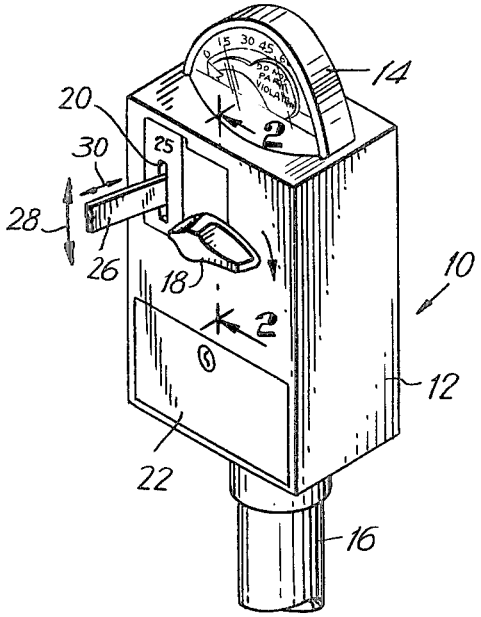
FIG. 1 is an isometric representation of a parking meter constructed according to the present invention, showing particularly a coin opening thereof and an insertion therethrough of a sharp object for the purpose of illegally actuating the mechanism.

Referring to the drawings, and particularly FIG. 1 thereof, a parking meter generally designated 10 is shown to include a coin and mechanism box 12, at the top of which a time indicator display 14 visually relates the present condition of the mechanism. Parking meter 10 also includes a support pole 16 and a winding knob 18, which with the insertion of a coin through coin opening 20, actuates the mechanism. Of course, a coin access door 22 is provided in the coin and mechanism box 12 to enable authorized access to the coins deposited in parking meter 10.

Normally, a parking meter 10, such as the one shown, is actuated by insertion of coins through coin opening 20 and thereafter clockwise turning of a knob 18. The insertion of the coin moves a pawl into position for turning the winding ring 24 (FIG. 2) of the mechanism, thus registering parking time on the display 14.

One wishing to actuate the mechanism without a coin substitutes a sharp object 26 which can be moved in the direction of arrows 28, 30 so that winding ring 24 is engaged with sharp object 26 as it would have been engaged by a pawl in response to a coin.

Figure 2:
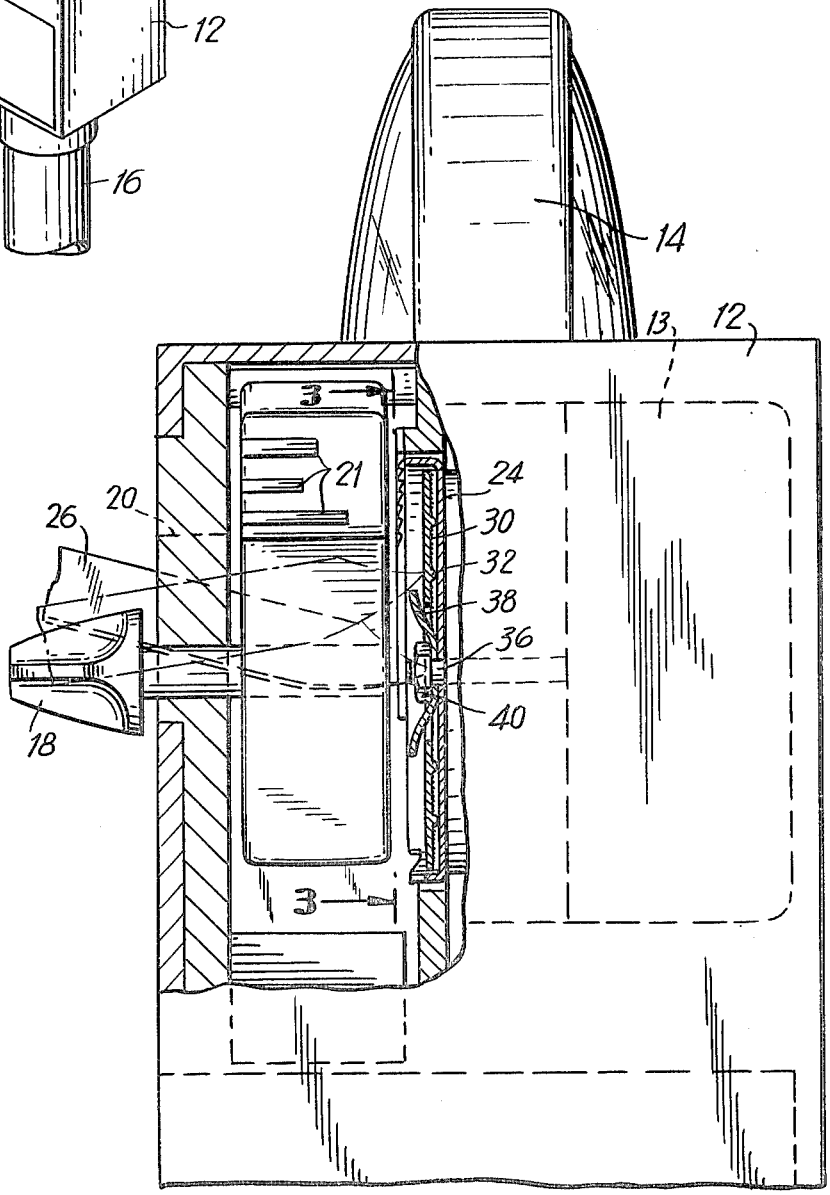
FIG. 2 is a side sectional view taken along the line 2—2 of FIG. 1 and showing particularly the engagement of a sharp object with the shield of the present invention to thereby prevent undesired actuation of the timing mechanism by means of manipulating the winding ring.

FIG. 2 shows the present invention in the environment of the standard parking meter mechanism 13, wherein winding ring 24 is placed in face-to-face proximity with protective shield 30, having ridges 32 in a low friction engagement. Thus, when a sharp object 26 is inserted through coin opening 20, its engagement will be with shield 30, which slides harmlessly with respect to winding ring 24, instead of actuating the time mechanism by motion of the winding ring. On the other hand, insertion of a coin through coin opening 20 into coin slots 21 will nevertheless, with turning of knob 18, cause pawls to engage winding ring 24 for actuation of meter mechanism 13.

Figure 3:
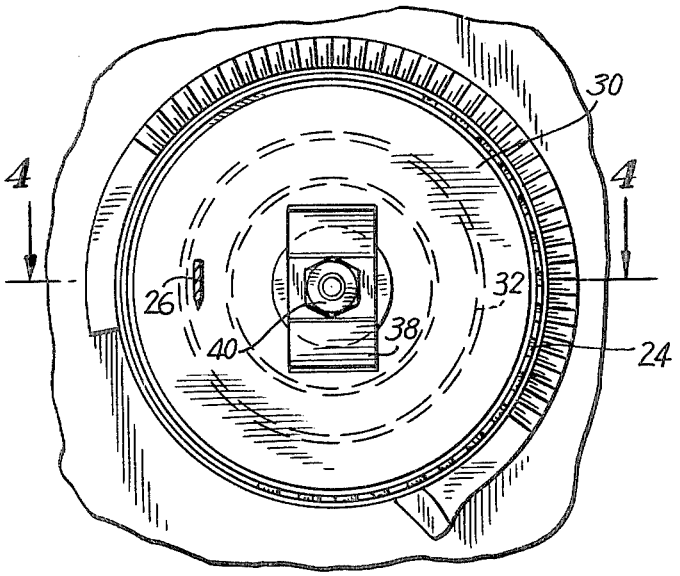
FIG. 3 is a front sectional view taken along the line 3—3 of FIG. 2 and showing particularly the winding ring covered by the shield of the present invention to prevent contact between the sharp object and the winding ring.

FIG. 3 shows, in more detail, shield 30 with ridges 32 as it protects winding ring 24 against a sharp object 26, or the like.

Figure 4:
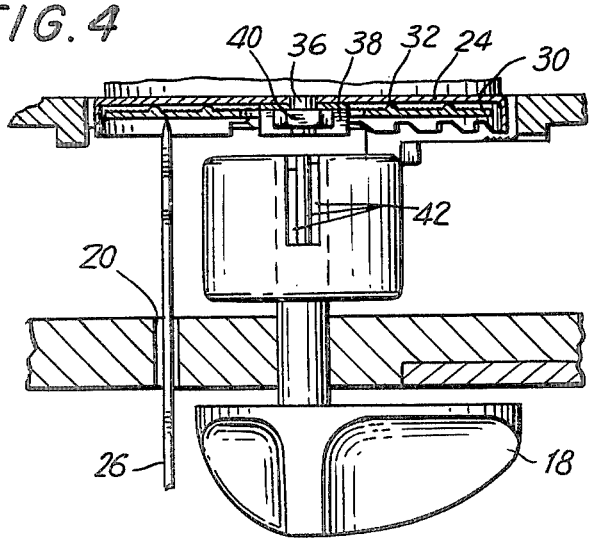
FIG. 4 is a top sectional view taken along line 4—4 of FIG. 3 and showing still another view of the winding ring as protected against contact with the sharp object by the shield of the present invention.

FIG. 4 shows the present invention in still greater detail wherein winding ring 24 is protected by protective shield shield 30, having rigdes 32. As may be seen particularly in FIGS. 2, 3 and 4, the winding ring 24 is journaled to a shaft 36 and protective shield 30 placed thereover and held in place by leaf spring 38, and affixed by standard parking meter element, lock nut 40. Thus, when sharp object 26 is inserted through coin opening 20, instead of actuating pawls 42 by means of a coin, protective shield 30 will protect winding ring 24 from that object.

Figure 6:
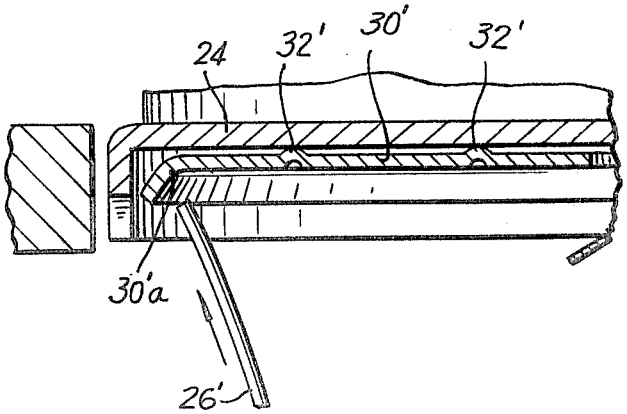
FIG. 6 is a partial sectional view, enlarged, showing the protection of the winding ring by means of the shield of an alternative embodiment of the present invention and particularly showing a shield shoulder for preventing access to the teeth of the winding ring by means of insertion of a sharp object at an angle through the coin opening.

FIG. 6 shows an alternative embodiment whereby an angularly positioned object 26' is prevented from contacting winding ring 24 by means of protective shield 30' having shoulders 30'*a*. Accordingly, sharp object 26' serves only to move protective shield 30' harmlessly against winding ring 24, and the low friction surface on ridges 32' prevent turning of the winding ring, or the actuation thereof. Thus, it may be seen that the present invention, with very slight design modifications thereof, can prevent access to winding rings of various curvatures at the periphery thereof.

Figure 5:
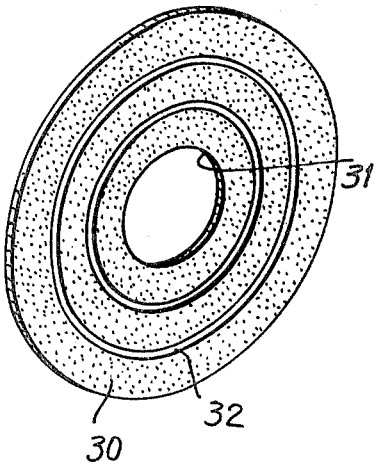
FIG. 5 is an isometric view of the shield of the present invention.

The present invention thereby prevents a common means for illegaly actuating parking meters. The inner surface of shield 30 is either of a galvanized material or any non-rust surface such as stainless steel, or spring steel. Also, the low friction material for ridges 32, 32' is covered with Teflon so that its contact will not cause motion of the winding ring. Furthermore, leaf spring 38 may be reversed for engaging central opening 31 (FIG. 5) of shield 30 and is constructed of spring steel, or the like.

The above description of the present invention is for purposes of illustration only, and the present invention is to be limited solely by the following claims:

What is claimed is:

1. A parking meter mechanism for use in a parking meter having a time indicating display, a winding knob, a housing defining a coin opening and an annular winding ring whose motion actuates a timing mechanism for causing a time indication to be shown by said display, comprising an annular protective shield coaxial and proximate to said winding ring and covering most of the area of said winding ring, means for holding said shield in its position with respect to said winding ring and low friction means positioned between said shield and said winding ring, all adapted and arranged such that attempted tampering with said mechanism for the purpose of moving said winding ring results in contact with said shield, moving said shield to a position abutting said winding ring and slidable motion of said shield relative to said winding ring.

2. The invention according to claim 1 wherein said means for holding comprises a leaf spring.

3. The invention according to claim 1 wherein said low friction means comprises a low friction coating for said shield.

4. The invention according to claim 1 wherein said low friction means comprises a plurality of ridges having a low friction coating affixed to said shield.

5. The invention according to claim 1 wherein said shield comprises a shoulder upstanding outwardly from the area of proximity between said shield and said ring for preventing angular access to said ring through said coin opening.

* * * * *